United States Patent [19]

MacIntyre et al.

[11] 4,063,472

[45] Dec. 20, 1977

[54] REMOTELY ACTUATABLE DEVICE FOR ROTARY KNOB

[76] Inventors: Robert W. MacIntyre, 103 Grove St., Concord, Mass. 01742; Edward J. Wysocki, 5 Radford Place, Hyde Park, Mass. 02136

[21] Appl. No.: 725,709

[22] Filed: Sept. 23, 1976

[51] Int. Cl.[2] ..... B25B 13/48

[52] U.S. Cl. ..... 81/3 R; 81/90 B; 81/125

[58] Field of Search ..... 81/3 R, 58.5, 90 B, 81/90 C, 120, 125; 251/231

[56] References Cited

U.S. PATENT DOCUMENTS

| | | | |
|---|---|---|---|
| 2,518,088 | 8/1950 | Spielman | 81/90 C |
| 2,536,172 | 1/1951 | Halperin | 81/90 C |
| 3,603,181 | 9/1971 | Shultz | 81/90 C |

FOREIGN PATENT DOCUMENTS

| | | | |
|---|---|---|---|
| 553,036 | 3/1923 | France | 81/58.5 |

*Primary Examiner*—James L. Jones, Jr.
*Assistant Examiner*—James G. Smith
*Attorney, Agent, or Firm*—Joseph Zallen

[57] ABSTRACT

A remotely actuatable device for controlling a rotary knob or the like which includes an annular plate and an annular toothed member with a handle pivotally mounted on the plate and having a toothed end engagable with said annular toothed member.

2 Claims, 5 Drawing Figures

REMOTELY ACTUATABLE DEVICE FOR ROTARY KNOB

BACKGROUND OF INVENTION

This invention relates to a remotely actuatable device for controlling the position of rotary adjustment knobs and the like.

In various types of machine tools, as for example collet holding fixtures, the precise adjustments needed are usually done manually by means of a knurled knob or the like. However, because of the design of certain machines and their positioning with respect to adjacent machines, it is often difficult to make the precise manual adjustments because of inaccessibility of the knob.

One object of the present invention is to provide a device for remote actuation of an adjustment knob.

A further object of this invention is to provide a device for adjusting a collet in a collet closing apparatus or indexing fixture.

A further object of this invention is to provide a remotely operable device for rapidly tightening or loosening a collet for insertion or removal.

Still another object of this invention is to provide a safe, remote method of adjusting a collet, without the operator needing to place his hands within the confines of the indexing fixture.

Another object is to provide a mechanical advantage for applying torque to a knob for situations when the operator is not strong enough to accomplish the task conveniently by hand.

Further objects and advantages of this invention will be apparent from the description and claims which follow taken together with the appended drawings.

SUMMARY OF INVENTION

The remote adjusting device of this invention comprises a toothed, annular member adapted to be fitted over and attached to the adjustment knob of a collet indexing fixture or the like. An annular plate which also fits over the knob and extends beyond the teeth is positioned adjacent the toothed member. The plate has a loop capable of pivoting on its vertical axis adjacent to the teeth, a handle member having a toothed end and a transverse slot cooperable with the loop and a pin extending across the slot through the loop to form a pivotal connection between the handle and the plate so that the handle may be flipped over from one side to the other. When flipped in one position, the toothed end of the handle engages a notch between the teeth so that movement of the handle will cause the toothed annular member to move in one direction when the handle is pushed in that direction. When the handle is pushed in the other direction, the toothed end of the handle is disengaged from the toothed annular member and moves with the annular plate while the toothed annular remains stationary. When the handleis again moved in the original direction a new notch is engaged by the tooth on the end of the handle. If the handle is flipped in the other direction to engage another notch between two adjacent teeth on the toothed annular member, movement of the handle will cause rotation of the toothed wheel member in the opposite direction. Inasmuch as the toothed member is attached to the adjustment knob, moving the handle toward the toothed side mores the adjustment knob in the same selected direction.

BRIEF DESCRIPTION OF INVENTION

SPECIFIC EXAMPLE OF INVENTION

Figure 1:
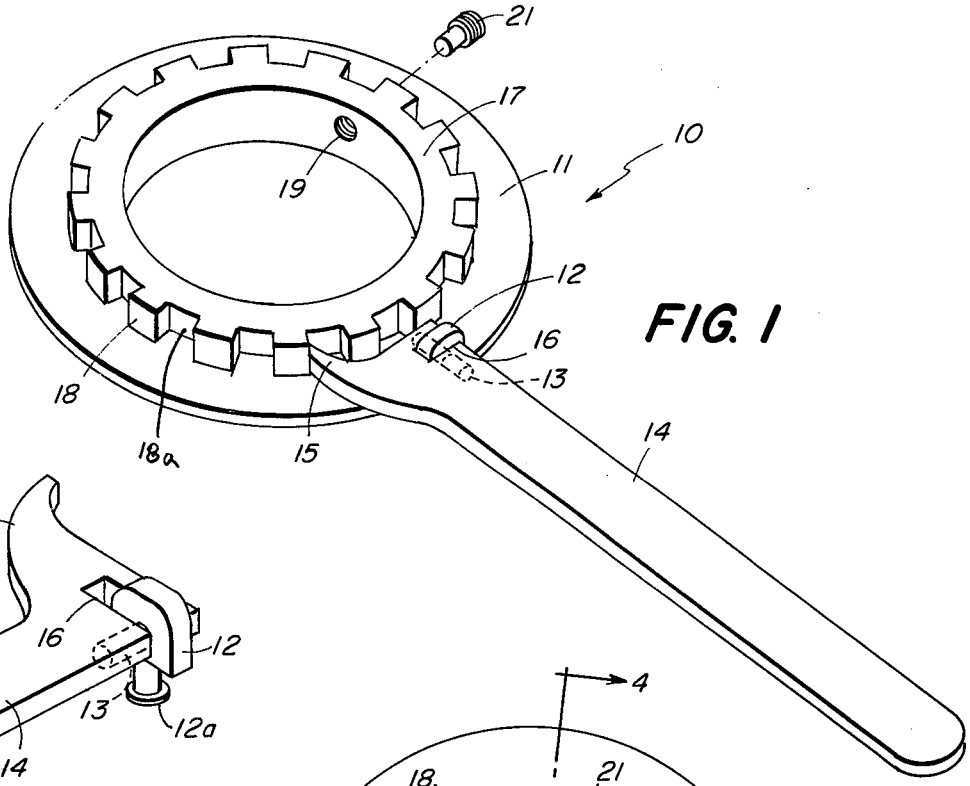
FIG. 1 is a perspective view of a device made in accordance with this invention.
Figure 1A:
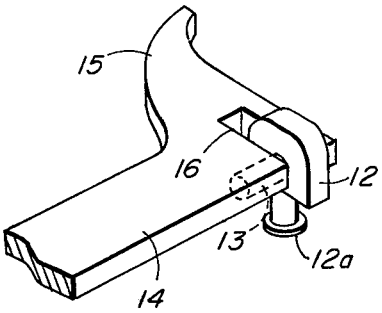
FIG. 1A is an enlargement of a portion of FIG. 1.
Figure 2:
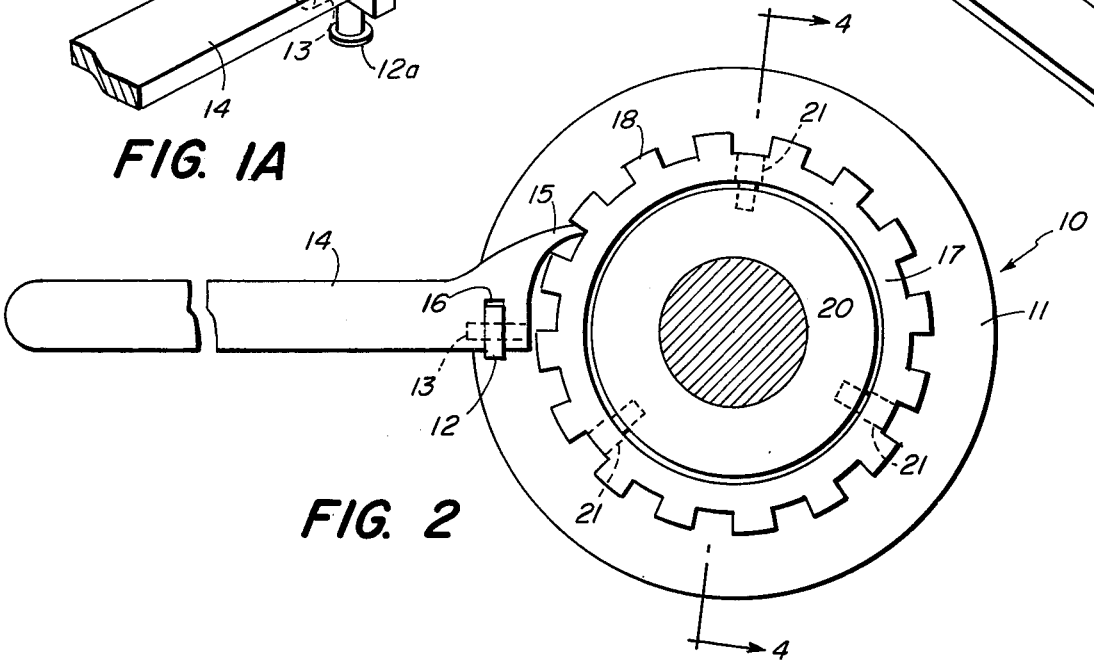
FIG. 2 is a plan view showing the device in position on a knurled knob of a collet chuck.
Figure 3:
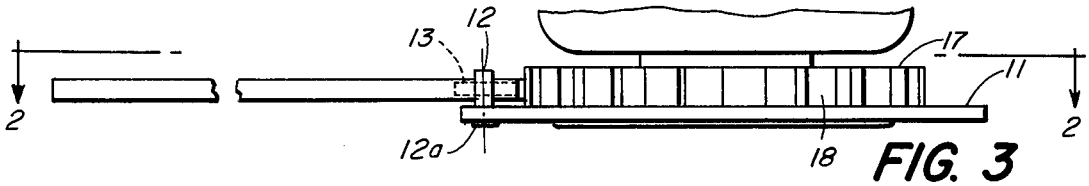
FIG. 3 is a side view of the device in position on the knob.
Figure 4:
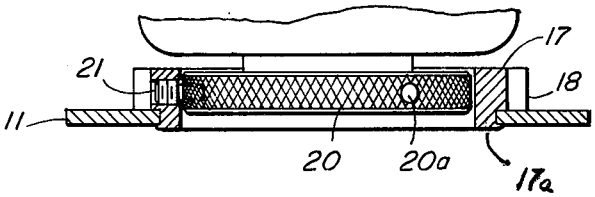
FIG. 4 is a partial sectional along line 4—4 of FIG. 2.

Referring now to the drawings, there is illustrated therein a collet chuck adjusting device 10 made in accordance with this invention. Annular member 17 having peripheral spaced teeth 18 and notch 18a is adapted by means of screws 21 extending through orifices 19 to be attached to a knob 20 over which the device is placed. Annular toothed member 17 fits into unattached annular plate 11 with a bottom section **17*a*. Annular plate 11 is wider than toothed member 17 and has attached to its exposed surface rotatable vertical pin 12*a*. Loop 12 is supported by pin 12*a*. Plate handle 14, having a toothed edge 14 engagable with a notch 18*a*, has a slot in which loop 12 is positioned. A pin 13 extends across the slot 16 through the loop 12. Handle 14 can be flipped from one side to the other and thus serve as a means for selectively moving the toothed member 17** clockwise or counter-clockwise and thus giving the desired adjustment to the knurled knob.

The device is readily attachable to a knob or the like and provides easy manipulable remote actuation of a knob in a safe manner. In connection with machine tools this enables the operator to avoid the hazard of accumulated chips or slivers or the like if he must use his own hand to adjust the knob, or to provide the leverage necessary to rotate a tight nut.

I claim:

1. A device for remote, precise rotary adjustment, comprising in combination a rotary adjustment knob, an annular toothed member fitted over and attached to said knob, an annular plate adjacent said toothed member and movable with respect thereto and a handle member pivotally connected to said plate and having a toothed end engagable with a notch in said annular toothed member; said device being characterized in that when said toothed end is engaged with a notch, movement of the handle in one direction moves said toothed member in the same direction; said handle being pivotable so as to be engageable with a notch on the opposite side to permit motion in the opposite direction by actuation of the handle.

2. A remotely actuatable device for controlling a rotary knob (20) or the like, comprising:

a. an annular toothed member (17) having notches **(18*a*) and adapted to be fitted over and attached to such a knob (20)**;

b. an annular plate (11) adjacent said toothed member (17) and movable with respect thereto;

c. a loop (12) rotatably positioned on said plate;

d. a handle member (14) having a toothed end (15) and a transverse slot (16) positioned so that said loop extends into said slot; and e. a pin (13) extending across said slot (16) through said loop (12) so as to form a pivotal connection between said handle (14) and said plate (11);

said device being characterized in that said handle toothed end (15) is engagable with a notch **(18*a*) so that when said handle is moved in one direction said toothed member is moved in the same direction; said handle being pivotable so as to be engagable with a notch (18*a*)** on the opposite side of said loop as to permit motion in the opposite direction by actuation of the handle.

* * * * *